US006827420B2

(12) United States Patent
Campbell et al.

(10) Patent No.: US 6,827,420 B2
(45) Date of Patent: Dec. 7, 2004

(54) DEVICE VERIFICATION USING PRINTED PATTERNS AND OPTICAL SENSING

(75) Inventors: Michael Clark Campbell, Lexington, KY (US); Gregory Scott Woods, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 32 days.

(21) Appl. No.: 10/323,050

(22) Filed: Dec. 18, 2002

(65) Prior Publication Data

US 2004/0119769 A1 Jun. 24, 2004

(51) Int. Cl.[7] ..... B41J 29/393; B42D 15/00; B42D 15/10

(52) U.S. Cl. ..... 347/19; 283/70; 283/72

(58) Field of Search ..... 347/19; 283/70, 283/72

(56) References Cited

U.S. PATENT DOCUMENTS

| | | | | |
|---|---|---|---|---|
| 4,813,912 A | | 3/1989 | Chickneas et al. | 364/464.02 |
| 4,872,027 A | | 10/1989 | Buskirk et al. | 347/19 |
| 5,594,840 A | * | 1/1997 | Sahay et al. | 358/1.14 |
| 5,613,007 A | | 3/1997 | Balga, Jr. | 380/51 |
| 5,796,414 A | * | 8/1998 | Sievert et al. | 347/19 |
| 5,831,649 A | | 11/1998 | Watrobski et al. | 3117/19 |
| 5,898,443 A | | 4/1999 | Yoshino et al. | 347/19 |
| 6,000,773 A | | 12/1999 | Murray et al. | 347/7 |
| 6,000,774 A | * | 12/1999 | Nambudiri | 347/7 |
| 6,164,758 A | | 12/2000 | Kretschmer | 347/50 |
| 6,212,505 B1 | | 4/2001 | Herbert | 705/408 |
| 6,263,170 B1 | | 7/2001 | Bortnem | 399/13 |
| 6,299,274 B1 | | 10/2001 | Bolash et al. | 347/19 |
| 6,362,893 B1 | | 3/2002 | Francis et al. | 358/1.14 |
| 6,406,120 B2 | | 6/2002 | Pauschinger | 347/19 |
| 6,431,679 B1 | * | 8/2002 | Li et al. | 347/19 |
| 6,435,638 B1 | * | 8/2002 | Wilson et al. | 347/7 |
| 6,669,322 B2 | * | 12/2003 | Gaston et al. | 347/19 |
| 2001/0020961 A1 | | 9/2001 | Pauschinger | 347/19 |
| 2002/0051167 A1 | | 5/2002 | Francis et al. | 358/1.14 |
| 2002/0054692 A1 | | 5/2002 | Suzuki et al. | 382/100 |
| 2002/0063744 A1 | * | 5/2002 | Stephens, Jr. | 347/19 |
| 2002/0087494 A1 | | 7/2002 | Herbert | 705/408 |
| 2002/0105572 A1 | | 8/2002 | Testardi et al. | 347/107 |

* cited by examiner

*Primary Examiner*—Michael S Brooke
*Assistant Examiner*—Alfred Dudding
(74) *Attorney, Agent, or Firm*—Taylor & Aust, P.C.

(57) ABSTRACT

A device verification method includes the steps of providing a device including a memory and a print pattern generator communicatively coupled to the memory, the print pattern generator generating image data based at least in part on a first value actually stored in a first memory location in the memory; printing the image data to produce a printed verification pattern; scanning the printed verification pattern to generate a verification value; reading a memorized value purportedly stored in the first memory location of the memory; comparing the memorized value with the verification value; and evaluating the device based on a result of the comparing step.

43 Claims, 4 Drawing Sheets

DEVICE VERIFICATION USING PRINTED PATTERNS AND OPTICAL SENSING

BACKGROUND OF THE INVENTION

1. Field of the Invention

The present invention relates to device verification, and, more particularly, to device verification using printed patterns and the optical sensing thereof.

2. Description of the Related Art

Numerous attempts have been made to provide device verification in printing systems. Some such systems include, for example, the use of encryption/decryption, or identification cards, to ensure that an item is authorized to be used or that a particular person is authorized to use the printing system. Such systems, however, typically cannot prevent circumvention of system integrity through the installation of intrusive hardware.

What is needed in the art is a device verification method that reduces the possibility of a successful circumvention of system integrity by intrusive hardware.

SUMMARY OF THE INVENTION

The present invention provides device verification methods that reduce the possibility of a successful circumvention of system integrity by intrusive hardware.

The invention, in one form thereof, is directed to a device verification method. The method includes the steps of providing a device including a memory and a print pattern generator communicatively coupled to the memory, the print pattern generator generating image data based at least in part on a first value actually stored in a first memory location in the memory; printing the image data to produce a printed verification pattern; scanning the printed verification pattern to generate a verification value; reading a memorized value purportedly stored in the first memory location of the memory; comparing the memorized value with the verification value; and evaluating the device based on a result of the comparing step.

In another form thereof, the invention is directed to a device verification method including the steps of providing a device including a memory and a print pattern generator communicatively coupled to the memory, the memory including a plurality of memory locations for storing a corresponding plurality of data values, the print pattern generator generating image data based at least in part on the plurality of data values actually stored in the memory; printing the image data to produce a printed verification pattern; scanning the verification pattern to generate verification data; reading memorized values purportedly stored in the plurality of memory locations of the memory; comparing the memorized values with the verification data; and evaluating the device based on a result of the comparing step.

In still another form thereof, the invention is directed to a device verification method including the steps of providing a device including a memory and a print pattern generator communicatively coupled to the memory, the memory including a plurality of memory locations; printing image data to produce a printed verification pattern, the verification pattern including a plurality of areas, each area of the plurality of areas having a corresponding density that is varied in accordance with each memory location of the plurality of memory locations; scanning the verification pattern to generate verification data; reading memorized values purportedly stored in the plurality of memory locations of the memory; comparing the memorized values with the verification data; and determining whether the memorized values are valid.

An advantage of the present invention is that the possibility of a successful circumvention of system integrity by intrusive hardware is reduced.

Another advantage is the device verification is applicable to both a circuit containing memory to be verified, as well as the device to which the circuit is attached, such as a supply item for an imaging system.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
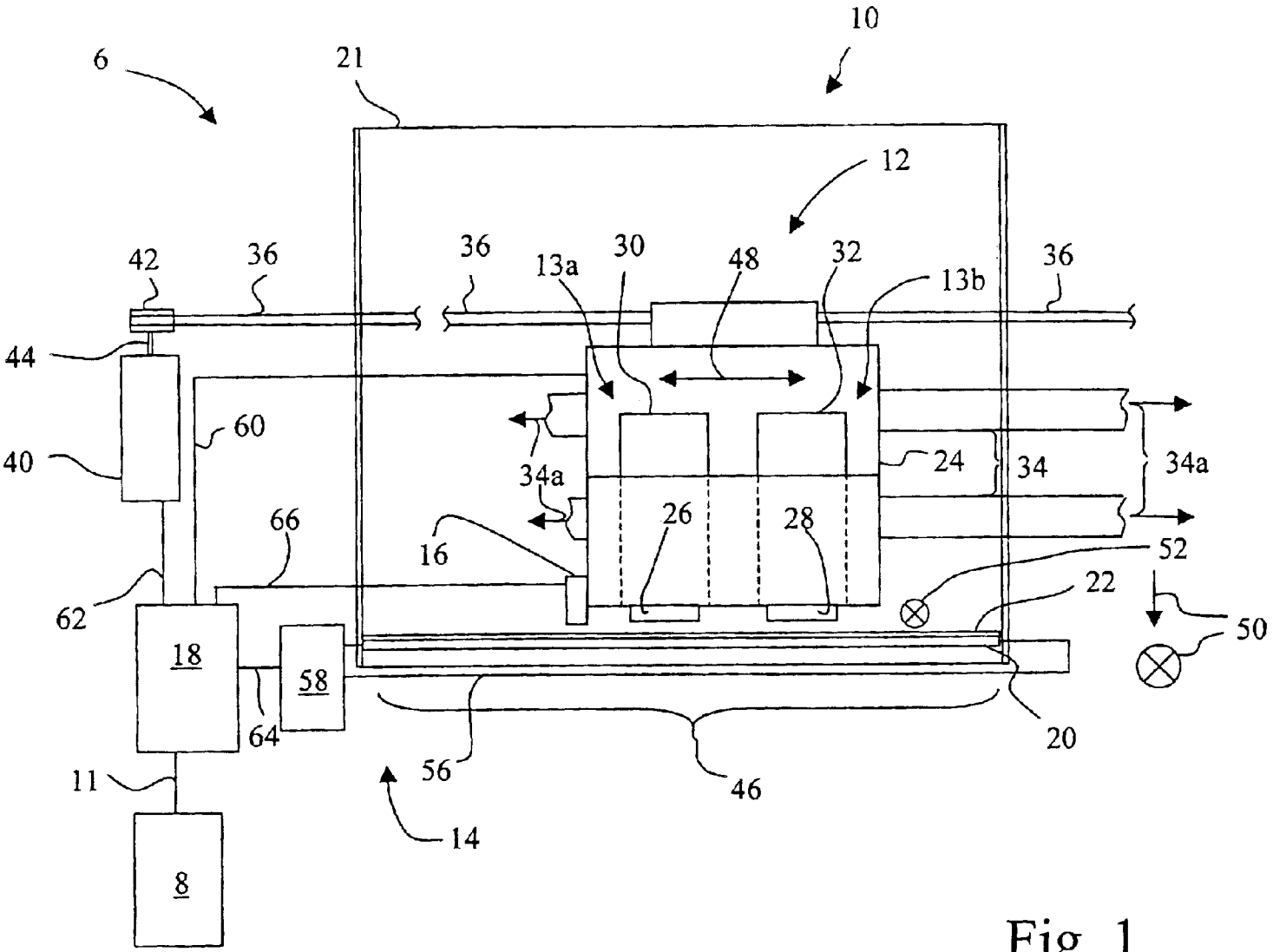
FIG. 1 is a diagrammatic representation of an imaging system embodying the present invention.

Referring now to the drawings, and particularly to FIG. 1, there is shown an imaging system 6 embodying the present invention. Imaging system 6 includes a computer 8 and an imaging apparatus 10, such as for example, an ink jet printer as shown. Computer 8 is communicatively coupled to ink jet printer 10 via a communications link 11. Communications link 11 may be, for example, a direct electrical or optical connection, or a network connection. Imaging apparatus 10 utilizes supply items 13*a* and 13*b* in forming a printed image, which include a supply of imaging substance, such as ink or toner.

Computer 8 is typical of that known in the art, and includes a display, an input device, e.g., a keyboard, a processor, and associated memory. Resident in the memory of computer 8 is printer driver software. The printer driver software places print data and print commands in a format that can be recognized by ink jet printer 10.

Ink jet printer 10 includes a printhead carrier system 12, a feed roller unit 14, a media sensor 16, a controller 18, a mid-frame 20 and a media source 21.

Media source 21, such as a media tray, is configured to receive a plurality of print media sheets from which a print media sheet 22 is supplied to feed roller unit 14, which in turn further transports print media sheet 22 during a printing operation. Print media sheet 22 can be, for example, coated paper, plain paper, photo paper and transparency media.

Printhead carrier system 12 includes a printhead carrier 24 for carrying supply items 13*a*, 13*b*. As shown, supply item 13*a* may include a monochrome printhead 26 and/or a monochrome ink reservoir 30 provided in fluid communication with monochrome printhead 26. Supply item 13*b* may include a color printhead 28 and/or a color ink reservoir 32 provided in fluid communication with color printhead 28. Monochrome printhead 26 and monochrome ink reservoir 30 may be combined as an integral printhead cartridge, or remotely coupled via a fluid conduit. Likewise, color printhead 28 and color ink reservoir 32 may be combined as an integral printhead cartridge, or remotely coupled via a fluid conduit. Printhead carrier system 12 and printheads 26, 28 may be configured for unidirectional printing or bi-directional printing.

Mounted to printhead carrier 24 is media sensor 16. In the context of the present invention, media sensor 16 is used to scan a verification pattern that is printed on print media sheet 22, from which a digital verification value will be derived. Media sensor 16 may, however, also be used to perform other sensing functions, such as for example, printhead alignment and media type sensing.

Printhead carrier 24 is guided by a pair of guide members 34. Each of guide members 34 may be, for example, a guide rod or a guide rail. The axes 34*a* of guide members 34 define a bi-directional scanning path for printhead carrier 24, including media sensor 16, and thus, for convenience the bi-directional scanning path will be referred to as bi-directional scanning path 34*a*. Printhead carrier 24 is connected to a carrier transport belt 36 that is driven by a carrier motor 40 via carrier pulley 42. Carrier motor 40 has a rotating carrier motor shaft 44 that is attached to carrier pulley 42. At the directive of controller 18, printhead carrier 24 and media sensor 16 are transported in a reciprocating manner along guide members 34. Carrier motor 40 can be, for example, a direct current (DC) motor or a stepper motor.

The reciprocation of printhead carrier 24 transports ink jet printheads 26, 28 and media sensor 16 across the print media sheet 22, such as paper, along bi-directional scanning path 34*a* to define a two-dimensional, e.g., rectangular, print zone 46 of printer 10. Due to the presence of media sensor 16 on printhead carrier 24, print zone 46 also defines a verification pattern scanning zone, which for convenience is referenced using the same element number 46 as used for the print zone. This reciprocation occurs in a main scan direction 48. The print media sheet 22 is transported in a sheet feed direction 50. In the orientation of FIG. 1, the sheet feed direction 50 is shown as flowing down media source 21, and toward the reader (represented by an X) along mid-frame 20. Main scan direction 48, which is commonly referred to as the horizontal direction, is parallel with bi-directional scanning path 34*a* and is substantially perpendicular to sheet feed direction 50, which is commonly referred to as the vertical direction. During each printing or optical sensing scan of printhead carrier 24, the print media sheet 22 is held stationary by feed roller unit 14.

Mid-frame 20 provides support for the print media sheet 22 when the print media sheet 22 is in print zone 46, and in part, defines a portion of a print media path 52 of ink jet printer 10. Mid-frame 20 may include, for example, a plurality of horizontally spaced support ribs (not shown).

Feed roller unit 14 includes a feed roller 56 and corresponding pinch rollers (not shown). Feed roller 56 is driven by a drive unit 58 (FIG. 1). The pinch rollers apply a biasing force to hold the print media sheet 22 in contact with respective driven feed roller 56. Drive unit 58 includes a drive source, such as a stepper motor, and an associated drive mechanism, such as a gear train or belt/pulley arrangement. Feed roller unit 14 feeds the print media sheet 22 in the sheet feed direction 50.

Contained within media sensor 16 are electrical sensory components, such as for example, a light source, a specular detector and/or a diffuse detector, the configuration and operation of which is known in the art. In its simplest form, the light source may include, for example, a light emitting diode (LED). In a more complex form, the light source may further include additional optical components for generating a collimated light beam. Each of the specular detector and/or the diffuse detector can be, for example, a phototransistor. The phototransistor provides an analog signal output whose voltage, or current, output varies as a function of the intensity of the reflected light that it receives from print media sheet 22. Media sensor may further include analog-to-digital conversion circuitry for converting the analog signal into a digital signal that can be read by controller 18.

Controller 18 is electrically connected and communicatively coupled to printheads 26 and 28 via a printhead interface cable 60. Controller 18 is electrically connected and communicatively coupled to carrier motor 40 via an interface cable 62. Controller 18 is electrically connected and communicatively coupled to drive unit 58 via an interface cable 64. Controller 18 is electrically connected and communicatively coupled to media sensor 16 via an interface cable 66.

Controller 18 includes a microprocessor having an associated random access memory (RAM) and read only memory (ROM). Controller 18 may be in the form of an application specific integrated circuit (ASIC).

Controller 18 executes program instructions to effect the printing of an image on the print media sheet 22. During printing, printhead carrier 24 is commanded to scan across print media sheet 22, and ink is ejected from one or both of printheads 26 and 28 to print a respective print swath. The term "print swath" is used to define a region traced by the corresponding printhead that extends across the width of the page in main scan (horizontal) direction 48 and extends in the sheet feed (vertical) direction 50 by a height corresponding to the length of the printhead nozzle array of the corresponding printhead. Following the completion of the printing of a print swath, controller 18 commands drive unit 58 to rotate feed roller 56 to advance print media sheet 22 by a predetermined amount in sheet feed direction 50, after which the next print swath is printed. This process repeats unit all print data to be printed on print media sheet 22 is printed.

In addition, controller 18 executes instructions in relation to the device verification methods of the invention, which include instructions for the printing of verification patterns, and the optical sensing of the printed verification patterns, associated with the device to be verified. Thus, as will become more clear from the discussions that follow, the device verification methods can be used to verify that a device is, for example, proper or authorized for use in imaging apparatus 10. The device being verified can be, for example, one or more of printhead 26, ink reservoir 30, supply item 13*a*, or the circuitry associated therewith.

Figure 2:
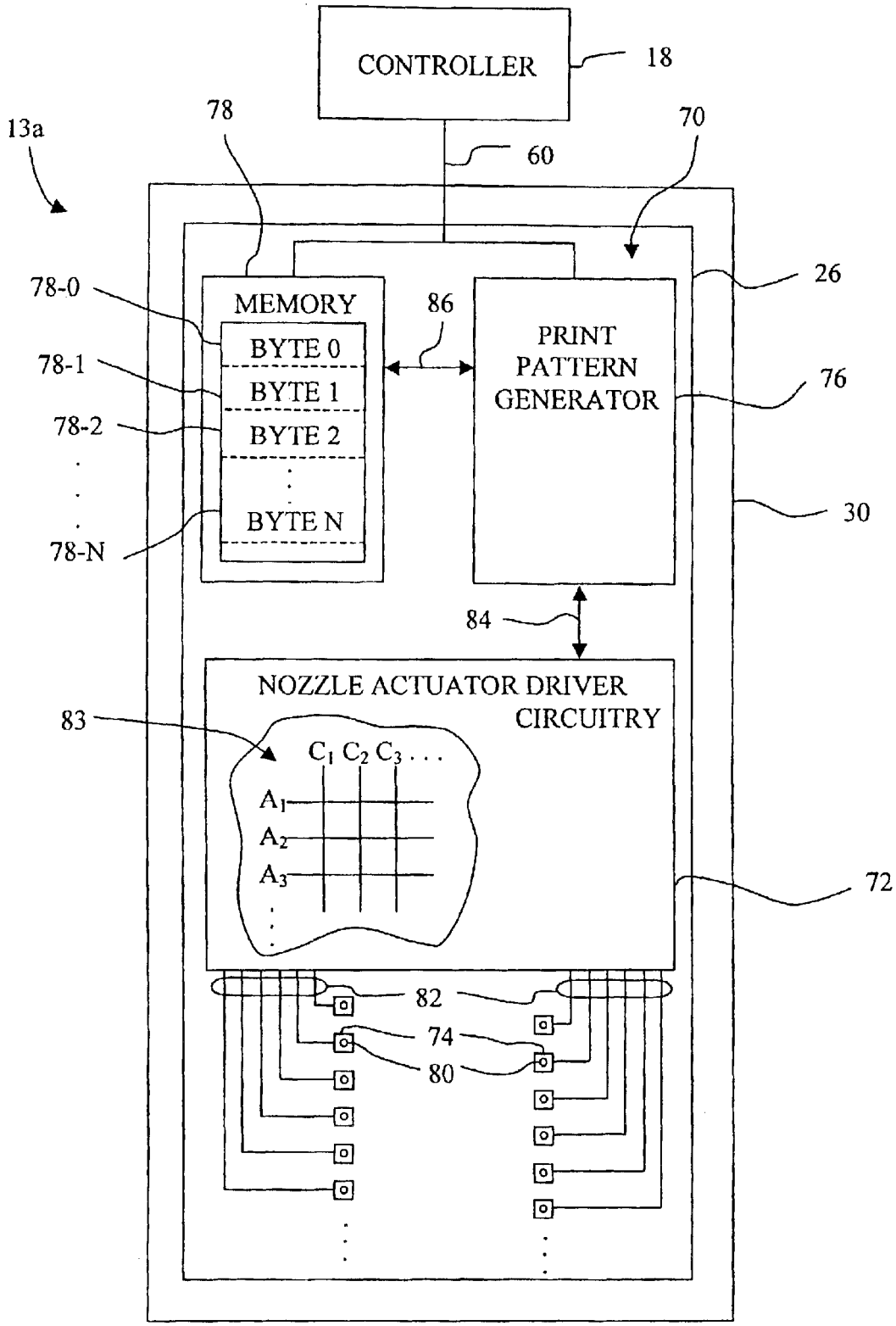
FIG. 2 is a diagrammatic representation in a simplified block diagram form showing a controller electrically coupled to a circuit formed integral with one of the printheads, of the imaging system of FIG. 1.

FIG. 2 is a simplified block diagram showing controller 18 electrically coupled to a circuit 70. In the embodiment shown, circuit 70 is formed integral with printhead 26, which in turn is attached to ink reservoir 30, the combination of which form supply item 13*a*. Circuit 70 includes, for example, nozzle actuator driver circuitry 72, a plurality of individually selectable ink ejection actuators 74 depicted by squares, a print pattern generator 76 and a memory 78, all of which may be formed on a single silicon substrate. Printhead 26 includes a plurality of ink ejection nozzles 80, depicted by circles, each corresponding to a respective one of the plurality of individually selectable ink ejection actuators 74. Each of ink ejection actuators 74 may be, for example, a resistive heater element or a piezoelectric element.

Nozzle actuator driver circuitry 72 is electrically coupled to the plurality of individually selectable ink ejection actuators 74 via a plurality of individually selectable conductors 82. Within nozzle actuator driver circuitry 72 is a matrix 83 of address lines, e.g., A1, A2, A3, . . . , and control lines, e.g., C1, C2, C3, . . . , which facilitate the individual election of ink ejection actuators 74, wherein each address line in used to select a predefined subset of the plurality of individually selectable ink ejection actuators 74. For example, address line A1 may be used to enable the upper 128 ink ejection actuators of a total of 512 ink ejection actuators in printhead 26.

Nozzle actuator driver circuitry 72 is communicatively coupled to print pattern generator 76 via communication link 84. Print pattern generator 76 is communicatively coupled to memory 78 via communication link 86. Each of print pattern generator 76 and memory 78 are communicatively coupled to controller 18 via printhead interface cable 60. Each of printhead interface cable 60, communication link 84, and communication link 86 may be, for example, electrical conductors.

Memory 78 includes a plurality of memory locations, identified as 78-0 to 78-N. For example, memory 78 may include sixteen memory locations in which case N is equal to fifteen. Each of the memory locations 78-0 to 78-N is capable of storing at least one bit of information, such as for example, one byte (eight bits) of information. At least some of the memory locations 78-0 to 78-N can be a write-once memory, such as a programmable read only memory (PROM), or one or more fusible link(s).

During normal printing, pattern generator 76 passes print data received from controller 18 to nozzle actuator driver circuitry 72, without modifying the data content. However, print pattern generator 76 is configured to selectively modify the received print data to generate image data in a predicable manner. For example, controller 18 may command print pattern generator 76 to generate image data for the printing of a verification pattern based upon the contents of one or more of memory locations 78-0 to 78-N of memory 78. For example, print pattern generator 76 may deplete the print data in a predetermined manner to generate image data to be printed having a density that corresponds to the value of Byte 0 stored in memory location 78-0. Alternatively, print pattern generator 76 may selectively temporarily mask certain address and/or control lines in nozzle actuator driver circuitry 72 to selectively temporarily mask printing with a predetermined subset of ink ejection actuators 74. As a further alternative, print pattern generator 76 may self generate image data based on the contents of one or more of memory locations 78-0 to 78-N of memory 78 through the use of internal pattern generators or registers, without the need of receiving print data from an external source.

As a more specific example, print pattern generator 76 may be a grayscale engine that generates grayscale image data based on one or more of the values stored in memory locations 78-0 to 78-N, wherein the image density of the print data received from controller 18 is reduced in accordance with the respective value of the accessed memory location. As an example, assume that the print data received from controller 18 represents data for printing a solid print swath at 100 percent coverage across the width of print media sheet 22 in main scan direction 48. Based on the contents of, for example Byte 0, print pattern generator 76 will deplete the print data to generate image data to be printed having a density that corresponds to the grayscale value associated with the value of Byte 0 stored in memory location 78-0. Thus, for example, each byte stored in memory locations 78-0 to 78-N could be used to affect the print density of a portion of a printed verification pattern on print media sheet 22. Such portions could be individual areas of a single swath, or could be multiple swaths.

As an alternative, print pattern generator 76 may control the generation of the verification pattern by individually accessing each bit stored in one or more of memory locations 78-0 to 78-N and generate image data by modifying the print data received from controller 18 in terms of the printing thereof, rather than by print data depletion. For example, each bit could be used to selectively enable or temporarily mask a particular address line in nozzle actuator driver circuitry 72, so as to selectably control a predefined subset of the plurality of ink ejection actuators 74 to be masked, based on the digital status, i.e., 0 or 1, of the particular bit being accessed. Thus, for example, each bit stored in memory locations 78-0 to 78-N could be used to affect the print density of a portion of a printed verification pattern on print media sheet 22. Such portions could be individual areas of a single swath, or could be multiple swaths.

Figure 3:
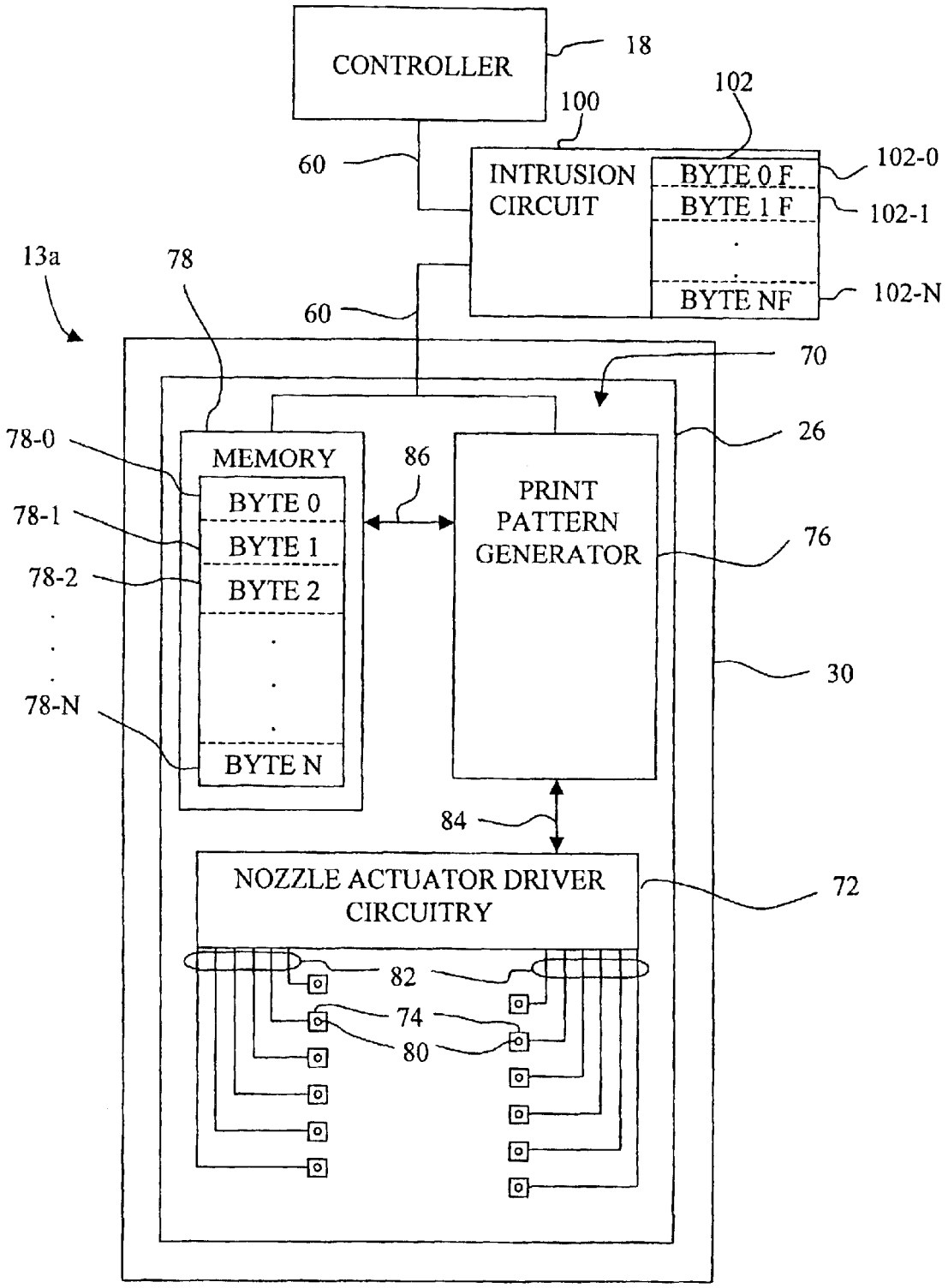
FIG. 3 is a diagrammatic representation including the components of FIG. 2, but modified with the inclusion of an intrusion circuit.

FIG. 3 shows the configuration of FIG. 2, which has been modified by the inclusion of an intrusion circuit 100 including an emulation memory 102. As shown, intrusion circuit 100 is interposed between controller 18 and circuit 70 of printhead 26. Intrusion circuit 100 might be used, for example, in trying to defeat the integrity of circuit 70, and in particular, memory 78, by emulating the operational presence of memory 78 with respect to controller 18, without replicating the contents of memory 78. Emulation memory 102 includes a plurality of false memory locations, 102-0 to 102-N, generally corresponding to memory locations 78-0 to 78-N of memory 78. Stored in memory locations 102-0 to 102-N are false values, designated as false bytes 0F to NF.

For example, assume that Byte 0 of memory location 78-0 of memory 78 stores a code representing the useable life to printhead 26, and that controller 18 attempts to access and read Byte 0. Intrusion circuit 100 could have a false value stored in Byte 0F at memory location 102-0 that indicates to controller 18 that the useable life of printhead 26 has not been reached, when if controller could access the actual value stored in Byte 0 of memory location 78-0 of memory 78, controller 18 would recognize that the usable life of printhead 26 had been reached. Thus, the device verification methods of the present invention are useful in detecting the presence of an intrusive circuit, such as intrusive circuit 100.

Figure 4:
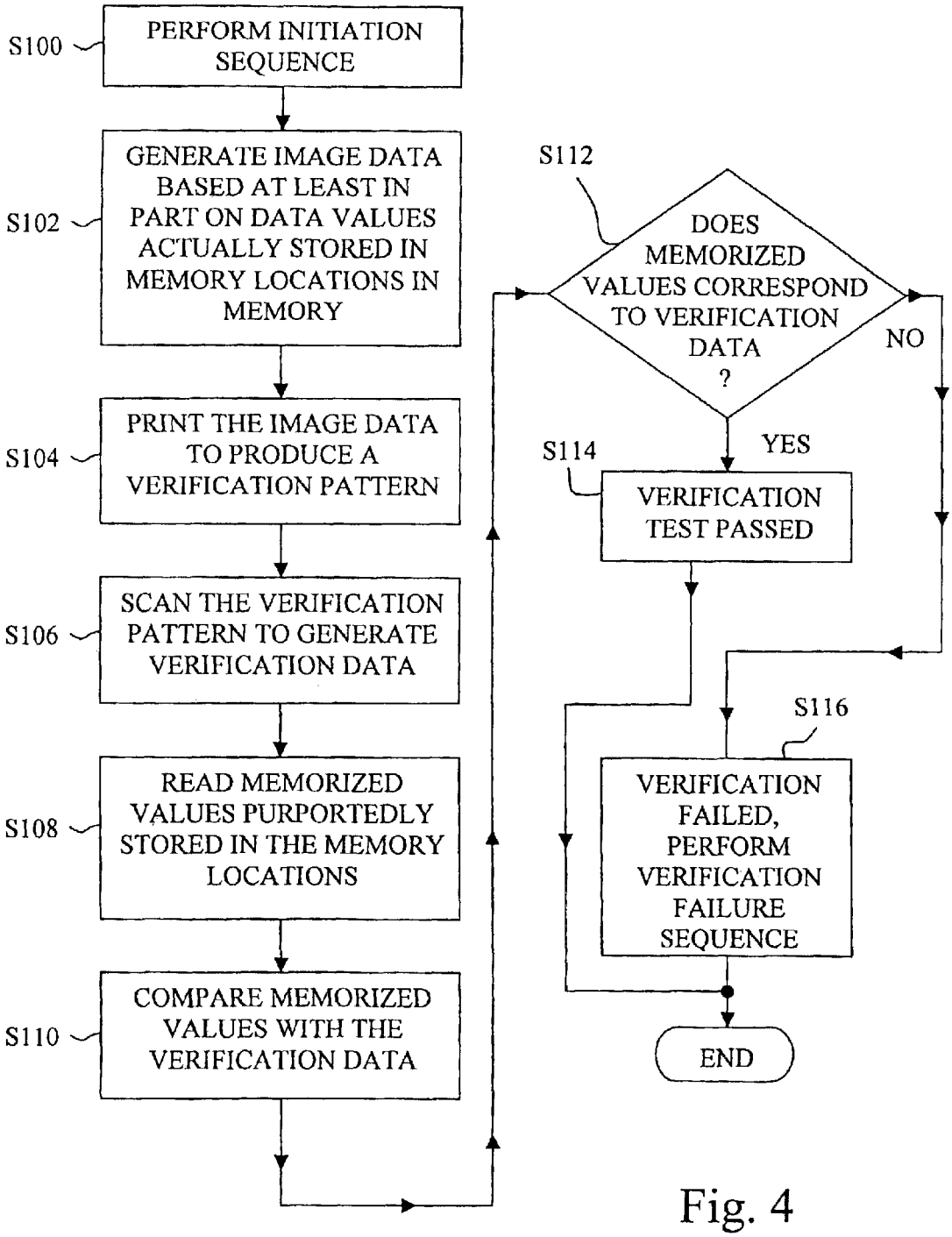
FIG. 4 is a general flowchart of a device verification method in accordance with the present invention.

FIG. 4 is a general flowchart of a device verification method in accordance with the present invention.

At step S100, an initialization sequence is performed. The initialization sequence is invoked when a predefined trigger event has occurred, such as for example, the changing of supply item 13*a*, the detection of installation of a new supply item 13*a*, or the change in a licensing status of supply item 13*a*. During the initialization sequence, media sensor is scanned across a blank area on print media sheet 22, so that controller 18 can determine a base value associated with the level of whiteness of print media sheet 22. The base value is used as a point of comparison when reading a verification pattern printed by, for example, printhead 26 on print media sheet 22.

At step S102, print pattern generator 76 generates image data based at least in part on one or more of the data values actually stored in memory locations 78-0 to 78-N of memory 78. For example, print pattern generator 76 may use one or more of the data values actually stored in memory locations 78-0 to 78-N of memory 78 to effect either print data depletion or selective line masking in nozzle actuator driver circuitry 72, thereby generating image data to control the printed output of printhead 26 to effect a predetermined printed image density. As a more specific example, print pattern generator 76 may generate the image data by modifying the print data received from controller 18, using one or more of the data values actually stored in memory locations 78-0 to 78-N of memory 78, to deplete the print data by removing and discarding some of the print data in a predetermined manner, wherein the generated image data is used to print at a corresponding density.

At step S104, imaging apparatus 10 prints the image data in the form of one or more print swaths to produce a printed verification pattern on print media sheet 22. The printed verification pattern may include a plurality of printed areas, with each of the plurality of printed areas having a grayscale density corresponding, respectively, to each of the data values stored in a respective memory location of the plurality of memory locations 78-0 to 78-N of memory 78.

As set forth above, print pattern generator 76 may operate on the values stored in memory 78 in a bit-wise, or byte-wise, manner to affect the print density of a portion of the printed verification pattern on print media sheet 22, wherein the data values are used to select various print density for printing the verification pattern. Such portions could be individual areas of a single swath, or could be areas of multiple swaths. In a bit-wise implementation, each bit is used to select a density of a corresponding portion, e.g., area, of the verification pattern, whereas in a byte-wise implementation, each byte is used to select a density of a corresponding portion of the verification pattern.

At step S106, controller 18 commands printhead carrier system 12 to scan media sensor 16 across the printed verification pattern to generate verification data. Media sensor 16 provides a signal from which the verification data is generated in the form of digital verification values, each value corresponding to one of the areas along the one or more print swaths.

At step S108, controller 18 attempts to read one or more memorized values purportedly stored in the memory locations 78-0 to 78-N of memory 78. However, if intrusion circuit 100 is present, rather than reading the actual values stored in memory 78, the false values stored in memory locations 102-0 to 102-N of emulation memory 102 will be read.

At step S110, the memorized values read in step S108 are compared with the verification data generated at step S106.

At step S112, in order to evaluate the device in question as being valid or invalid, it is determined whether the memorized values correspond to the verification data, such as for example, by determining whether the memorized values are equal to the verification data.

If, at step S112, the determination is that the memorized values correspond to the verification data, the process proceeds to step S114 where controller 18 determines that the device verification has passed. In this example, the device being verified can be considered to be any one of supply item 13*a*, ink reservoir 30, printhead 26, circuit 70 or memory 78. Upon passing the verification, the print media sheet 22 is ejected from imaging apparatus 10, and an indication of "Ready" is provided to the operator, such as via a user interface (not shown) on printer 10, or on the display of computer 8.

If, at step S112, the determination is that the memorized values do not correspond to the verification data, the process proceeds to step S116 where controller 18 determines that the memorized values are not valid, and in turn, determines that device verification has failed. Upon failing device verification, a verification failure sequence is performed wherein, for example, the print media sheet 22 is ejected from printer 10, and an indication that the verification has failed is provided to the operator, such as via the user interface on printer 10, or on the display of computer 8. The operator may then be instructed, for example, to reload or replace supply item 13*a*.

Exemplary Implementation 1

One implementation of the general device verification method of FIG. 4 will now be described. In this implementation, print pattern generator 76 is a grayscale generator, which will be referred to below as grayscale generator 76. For memory 78, N is equal to fifteen, such that memory 78 includes sixteen memory locations 78-0 to 78-15. Assume, for example, that Byte 0 of memory location 78-0 contains the binary value 01010101.

At step S100, controller 18 detects a change of supply item 13*a*, the replacing of supply item 13*a* with a new supply item, or a change in licensing status of supply item 13*a*. This detection can occur, for example, by temporary loss of electrical contact with circuit 70, or by reading certain predefined memory locations in memory 78. Controller 18 controls printhead carrier system 12 to scan media sensor 16 across a blank area on print media sheet 22, so that controller 18 can determine a base value associated with the level of whiteness of print media sheet 22. The base value is used as a point of comparison when reading a verification pattern printed by, for example, printhead 26 on print media sheet 22.

At step S102, controller 18 sequentially loads each of actual Bytes 0 to 15 stored in memory locations 78-0 to 78-15 into grayscale generator 76 to generate grayscale image data to effect a variation of the printed image density along the print swath. It is noted that since grayscale generator 76 and memory 78 are formed on the same silicon substrate, the writing of values from memory 78 to grayscale generator 76 are internal to circuit 70, and in turn, are internal to printhead 26. Thus, there is no opportunity for intrusion circuit 100 to cause grayscale generator 76 to load false values from emulation memory 102, even if intrusion circuit 100 is present.

Step S104 is repeated for each of the Bytes 0 to 15 stored respectively in memory locations 78-0 to 78-15, so as to print a verification pattern along the print swath having sixteen areas, each area corresponding to one of Bytes 0 to 15. Thus, assuming an eight inch print swath, each area would be one-half inch. Alternatively, each of Bytes 0 to 15 could be represented by a separate print swath. Thus, the verification pattern truly represents the contents of memory locations 78-0 to 78-15, even if intrusion circuit 100 is present. For example, Byte 0 of memory location 78-0 containing the binary value 01010101 might result in a reduction of a solid swath from 100 percent density coverage to a 30 percent density coverage pattern in the first area of the sixteen areas of the verification pattern.

At step S106, controller 18 commands printhead carrier system 12 to scan media sensor 16 across the printed verification pattern having sixteen areas. Media sensor 16 provides to controller 18 a signal from which the verification data is generated in the form of sixteen digital verification values, which for convenience, will be referred to as verification bytes VB-0 to VB-15, each value corresponding to one of the areas along the one or more print swaths.

At step S108, controller 18 attempts to read one or more memorized values purportedly stored in the memory locations 78-0 to 78-15 of memory 78. However, if intrusion circuit 100 is present, rather than reading the actual values stored in memory 78, the false Bytes 102-0F to 102-15F stored in memory locations 102-0 to 102-N of emulation memory 102 will be read by controller 18.

At step S110, the memorized values read in step S108 are sequentially compared with the corresponding verification bytes VB-0 to VB-15. For example, depending on whether intrusion circuit 100 is present, byte VB-0 will be compared to the memorized value corresponding to either Byte 0 or Byte 0F.

At step S112, controller 18 determines whether the memorized values are equal to the corresponding verification data bytes VB-0 to VB-15.

If, at step S112, controller 18 determines that all the memorized values correspond to the verification data, the process proceeds to step S114 where controller 18 determines that the device verification has passed. In this example, the device being verified can be considered to be any one of supply item 13*a*, ink reservoir 30, printhead 26, circuit 70 or memory 78. Upon passing the verification, the print media sheet 22 is ejected from printer 10, and an indication of ready is provided to the operator, such as via a user interface (not shown) on imaging apparatus 10, or on the display of computer 8.

If, at step S112, controller 18 determines that all the memorized values, e.g., Bytes 0F to 15F, do not correspond to the verification bytes VB-0 to VB-15, the process proceeds to step S116 where controller 18 determines that intrusion circuit 100 is present and that the memorized values purportedly stored at memory location 78-0 to 78-15 are not valid, and in turn, determines that device verification has failed. Upon failing device verification, controller 18 controls feed roller unit 14 to eject print media sheet 22 from imaging apparatus 10, and an indication that the verification has failed is provided to the operator, such as via the user interface on imaging apparatus 10, or on the display of computer 8. The operator may then be instructed, for example, to reload or replace supply item 13*a*.

Exemplary Implementation 2

Another implementation of the general device verification method of FIG. 4 will now be described. Exemplary Implementation 2 is substantially the same as Exemplary Implementation 1, except that at steps S102 and S104, rather that printing a solid swath of varying densities, certain designated bit patterns would result in the temporary masking of a predefined subset of ink ejection actuators 74 by dropping out one or more address and/or control lines in nozzle actuator driver circuitry 72. Assume, for example, that an address line A1 of nozzle actuator driver circuitry 72 controls the enabling of a subset of 128 nozzle actuators of a total of 512 nozzle actuators. Further assume that the grayscale value 01010101 will result in the masking of address line A1. If Byte 0 of memory location 78-0 contains the binary value 01010101, then when print pattern generator 76 reads Byte 0 of memory location 78-0, address line A1 will be masked, thereby removing from the corresponding area of the printed verification pattern the sub-area covered by the 128 nozzles. Then, at step S106, for the area associated with Byte 0, media sensor will be used to determine the presence or absence of print data in the sub-area associated with the 128 nozzles controlled by address line A1.

Exemplary Implementation 3

Still another implementation of the general device verification method of FIG. 4 will now be described. Exemplary Implementation 3 is substantially the same as Exemplary Implementation 1, except that at steps S102 and S104, rather that printing a solid swath of varying densities, the digital level of individual bits would result in the temporary masking of a predefined subset of ink ejection actuators 74 by dropping out one or more address and/or control lines in nozzle actuator driver circuitry 72. For example, each bit of each of memory locations 78-0 to 78-15 will individually control address line A1 nozzle actuator driver circuitry 72, each byte of memory locations 78-0 to 78-15 will be printed on a separate print swath, and all address lines other than A1 are masked. Thus, assuming an eight inch print swath, there will be sixteen print swaths, with each print swath including eight, one inch, areas. Each bit will be used to control address line A1. Thus, for example, a "1" bit will result in the 128 ink ejection actuators 74 associated with address line A1 being enabled, and a "0" bit will result in the 128 ink ejection actuators 74 associated with address line A1 being masked, i.e., having a density of zero. Accordingly, if Byte 0 of memory location 78-0 contains the binary value 01010101, then, at step S104, for the first pint swath including eight areas associated with the individual bits b7-b0 of Byte 0, no ink will be printed at the areas associated with bits b7, b5, b3, and b1. Then, at step S106, for example, for the areas associated with Byte 0, media sensor will be used to determine the presence or absence of print data in the eight areas of the first print swath to generate a verification byte.

Exemplary Implementation 4

Yet another implementation of the general device verification method of FIG. 4 will now be described. Exemplary Implementation 4 is substantially the same as Exemplary Implementation 3, except each bit would be cycled through a single bit location in print pattern generator 76. Each print swath would include bit-wise representations of multiple bytes of Byte 0 to Byte 15. For example, if each printed area is one-quarter inch, then four 8-bit memory locations could be verified along a single eight inch print swath.

While this invention has been described as having a preferred design, the present invention can be further modified within the spirit and scope of this disclosure. For example, while the invention was been described primarily in association with an ink jet printing system, those skilled in the art will recognize that the invention can be readily adapted for use in other types of imaging systems, such as for example, electrophotographic printing systems. Also, many of the descriptions relating to the invention were described, for sake of simplicity and ease of understanding, with respect to supply item 13*a*, monochrome printhead 26 or monochrome ink reservoir 30, but those skilled in the art will recognize that the present invention would equally apply to supply item 13*b*, color printhead 28 or color reservoir 32. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device verification method, comprising the steps of:

providing a device including a memory and a print pattern generator communicatively coupled to said memory, said print pattern generator generating image data based at least in part on a first value actually stored in a first memory location in said memory;

printing said image data to produce a printed verification pattern;

scanning said printed verification pattern to generate a verification value;

attempting to read a memorized value purportedly stored in said first memory location of said memory, wherein if an intrusion apparatus is present, then a false memory value stored in a memory associated with the intrusion apparatus, is read;

comparing said memorized value with said verification value; and evaluating said device based on a result of said comparing step.

2. The method of claim 1, wherein said evaluating step comprises the step of determining whether said memorized value corresponds to said verification value.

3. The method of claim 2, wherein if said memorized value corresponds to said verification value, then said device is verified as valid.

4. The method of claim 2, wherein if said memorized value does not correspond to said verification value, then said method comprising the further step of performing a verification failure sequence for said device.

5. The method of claim 1, wherein said print pattern generator generates said image data by modifying received print data using said first value actually stored in said memory.

6. The method of claim 1, wherein said device is a printhead.

7. The method of claim 6, wherein said memory and said print pattern generator are formed integral with said printhead.

8. The method of claim 1, wherein said device is a circuit.

9. The method of claim 1, wherein said device is a supply item.

10. The method of claim 1, wherein said first value is used to select a print density at which at least a portion of said verification pattern is printed.

11. The method of claim 1, wherein said print pattern generator is a grayscale engine that generates grayscale image data based on said first value, and wherein said printing step comprises printing a grayscale print pattern as said printed verification pattern based on said grayscale image data, and wherein said first value is loaded into said grayscale engine to generate said grayscale image data corresponding to said first value.

12. The method of claim 1, wherein said first value includes a plurality of bits, wherein each bit is used to select a density of a corresponding portion of said printed verification pattern.

13. The method of claim 1, wherein said first value is one of a plurality of values stored in a plurality of memory locations of said memory, and wherein the steps of providing and printing are performed for each of said plurality of values stored in said memory to generate said printed verification pattern.

14. The method of claim 1, wherein said image data is generated from print data received from a controller.

15. The method of claim 1, wherein said print pattern generator self generates said image data without receiving print data from an external source.

16. The method of claim 1, wherein said memory includes a plurality of memory locations, and wherein each of said plurality of memory locations include a corresponding actual value stored therein, and wherein said print pattern generator generates said image data based at least in part on each said corresponding actual value stored in said plurality of memory locations.

17. The method of claim 16, wherein said printed verification pattern includes a plurality of printed areas, each of said plurality of printed areas corresponding, respectively, to said each said corresponding actual value stored in said plurality of memory locations.

18. The method of claim 17, wherein said printed verification pattern comprises a single swath.

19. The method of claim 17, wherein said printed verification pattern comprises a plurality of swaths.

20. The method of claim 19, wherein each of said plurality of swaths corresponds, respectively, to contents of one of said plurality of memory locations.

21. A device verification method, comprising the steps of:

providing a device including a memory and a print pattern generator communicatively coupled to said memory, said memory including a plurality of memory locations for storing a corresponding plurality of data values, said print pattern generator generating image data based at least in part on said plurality of data values actually stored in said memory;

printing said image data to produce a printed verification pattern;

scanning said printed verification pattern to generate verification data;

reading memorized values purportedly stored in said plurality of memory locations of said memory;

comparing said memorized values with said verification data; and evaluating said device based on a result of said comparing step.

22. The method of claim 21, wherein said evaluating step comprises the step of determining whether said memorized values correspond to said verification data.

23. The method of claim 22, wherein if said memorized values correspond to said verification data, then said device is verified as valid.

24. The method of claim 22, wherein if said memorized values do not correspond to said verification data, then said method comprising the further step of performing a verification failure sequence for said device.

25. The method of claim 21, wherein said print pattern generator generates said image data by modifying received print data using said data values actually stored in said memory.

26. The method of claim 21, wherein said device is a printhead.

27. The method of claim 21, wherein said memory and said print pattern generator are formed integral with said printhead.

28. The method of claim 21, wherein said device is a circuit.

29. The method of claim 21, wherein said device is a supply item.

30. The method of claim 21, wherein said data values are used to select various print densities for printing said printed verification pattern.

31. The method of claim 21, wherein said print pattern generator is a grayscale engine, and wherein said plurality of data values are sequentially loaded into said grayscale engine to generate grayscale image data corresponding to said plurality of data values, and wherein said printing step comprises printing a grayscale print pattern as said printed verification pattern based on said grayscale image data.

32. The method of claim 21, wherein said data values includes a plurality of bits, wherein each bit is used to select a density of a corresponding portion of said printed verification pattern.

33. The method of claim 21, wherein said printed verification pattern includes a plurality of printed areas, each of said plurality of printed areas corresponding, respectively, to each of said plurality of data values stored in said plurality of memory locations.

34. The method of claim 33, wherein said printed verification pattern comprises a single swath.

35. The method of claim 33, wherein said printed verification pattern comprises a plurality of swaths.

36. The method of claim 21, wherein said image data is generated from print data received from a controller.

37. The method of claim 21, wherein said print pattern generator self generates said image data without receiving print data from an external source.

38. A device verification method, comprising the steps of:

providing a device including a memory and a print pattern generator communicatively coupled to said memory, said memory including a plurality of memory locations;

printing image data to produce a printed verification pattern, said verification pattern including a plurality of areas, each area of said plurality of areas having a corresponding density that is varied in accordance with each memory location of said plurality of memory locations;

scanning said printed verification pattern to generate verification data;

reading memorized values purportedly stored in said plurality of memory locations of said memory;

comparing said memorized values with said verification data; and determining whether said memorized values are valid.

39. The method of claim 38, wherein each of said plurality of memory locations stores at least one bit.

40. The method of claim 39, wherein each said bit is either a digital "0" or a digital "1", and wherein one of said digital "0" and said digital "1" corresponds to a density of zero.

41. The method of claim 38, wherein said plurality of areas are formed on one print swath.

42. The method of claim 38, wherein said plurality of areas are formed on multiple print swaths.

43. The method of claim 38, wherein said corresponding density includes a density of zero.

* * * * *